US007202845B2

(12) United States Patent
Koga et al.

(10) Patent No.: US 7,202,845 B2
(45) Date of Patent: Apr. 10, 2007

(54) LIQUID CRYSTAL DISPLAY DEVICE

(75) Inventors: Koichi Koga, Tokyo (JP); Tohru Kume, Tokyo (JP)

(73) Assignee: NEC LCD Technologies, Ltd. (JP)

( * ) Notice: Subject to any disclaimer, the term of this patent is extended or adjusted under 35 U.S.C. 154(b) by 0 days.

(21) Appl. No.: 10/212,451

(22) Filed: Aug. 5, 2002

(65) Prior Publication Data

US 2003/0025664 A1 Feb. 6, 2003

(30) Foreign Application Priority Data

Aug. 6, 2001 (JP) ..... 2001-238406

(51) Int. Cl.
*G09G 3/36* (2006.01)
*G09G 5/10* (2006.01)

(52) U.S. Cl. ..... 345/89; 345/690

(58) Field of Classification Search ..... 345/87, 345/88, 89, 90, 91, 92, 50–54, 94, 690
See application file for complete search history.

(56) References Cited

U.S. PATENT DOCUMENTS 5,583,530 A * 12/1996 Mano et al. ..... 345/89
5,784,042 A * 7/1998 Ono et al. ..... 345/94
6,020,869 A * 2/2000 Sasaki et al. ..... 345/89
6,353,435 B2 * 3/2002 Kudo et al. ..... 345/204
6,930,663 B2 * 8/2005 Sekiya et al. ..... 345/87
2001/0033262 A1 * 10/2001 Funakoshi et al. ..... 345/89
2002/0024481 A1 * 2/2002 Kawabe et al. ..... 345/87

FOREIGN PATENT DOCUMENTS

CN 1320829 7/2001
JP 2001-034232 2/2001

* cited by examiner

*Primary Examiner*—Richard Hjerpe
*Assistant Examiner*—Kevin M. Nguyen
(74) *Attorney, Agent, or Firm*—Hayes Soloway P.C.

(57) ABSTRACT

A liquid crystal display device which divides a pixel into a plurality of sub-pixels. In the liquid crystal display device, a gradation and a brightness in each of the sub-pixels have a non-linear relation to each other, and a desired brightness for the pixel is selected by selecting a gradation in each of the sub-pixels.

9 Claims, 15 Drawing Sheets

FIG.6

0-100 GRADATION

| | P1 | P2 | P3 |
|---|---|---|---|
| 0 | 0 | 0 | 0 |
| 1 | 0 | 0 | 1 |
| 2 | 1 | 1 | 1 |
| 3 | 1 | 1 | 1 |
| 4 | 2 | 2 | 1 |
| 5 | 2 | 1 | 1 |
| 6 | 2 | 2 | 2 |
| 7 | 2 | 2 | 2 |
| 8 | 4 | 3 | 2 |
| 9 | 4 | 3 | 2 |
| 10 | 4 | 3 | 2 |
| 11 | 5 | 3 | 2 |
| 12 | 5 | 3 | 2 |
| 13 | 5 | 4 | 2 |
| 14 | 6 | 3 | 1 |
| 15 | 6 | 4 | 2 |
| 16 | 6 | 4 | 4 |
| 17 | 7 | 5 | 2 |
| 18 | 7 | 4 | 2 |
| 19 | 7 | 4 | 4 |
| 20 | 7 | 5 | 4 |
| 21 | 8 | 5 | 3 |
| 22 | 8 | 4 | 4 |
| 23 | 8 | 6 | 4 |
| 24 | 8 | 5 | 1 |
| 25 | 8 | 5 | 3 |
| 26 | 8 | 5 | 3 |
| 27 | 9 | 6 | 3 |
| 28 | 10 | 5 | 2 |
| 29 | 10 | 4 | 4 |
| 30 | 10 | 5 | 4 |
| 31 | 10 | 6 | 4 |
| 32 | 11 | 5 | 1 |
| 33 | 11 | 4 | 4 |
| 34 | 11 | 6 | 3 |
| 35 | 11 | 6 | 5 |
| 36 | 11 | 7 | 5 |
| 37 | 12 | 4 | 3 |
| 38 | 12 | 6 | 2 |
| 39 | 12 | 6 | 5 |
| 40 | 12 | 7 | 5 |
| 41 | 13 | 5 | 3 |
| 42 | 13 | 5 | 4 |
| 43 | 13 | 6 | 5 |
| 44 | 13 | 7 | 5 |
| 45 | 13 | 8 | 5 |
| 46 | 14 | 5 | 1 |
| 47 | 14 | 6 | 4 |
| 48 | 14 | 7 | 5 |
| 49 | 14 | 8 | 4 |
| 50 | 15 | 5 | 1 |
| 51 | 15 | 6 | 4 |
| 52 | 15 | 7 | 2 |
| 53 | 15 | 8 | 2 |
| 54 | 16 | 6 | 0 |
| 55 | 16 | 5 | 2 |
| 56 | 16 | 6 | 3 |
| 57 | 16 | 7 | 4 |
| 58 | 16 | 8 | 5 |
| 59 | 16 | 9 | 4 |
| 60 | 17 | 5 | 2 |
| 61 | 17 | 6 | 3 |
| 62 | 17 | 7 | 5 |
| 63 | 17 | 8 | 5 |
| 64 | 17 | 9 | 5 |
| 65 | 18 | 5 | 0 |
| 66 | 18 | 6 | 3 |
| 67 | 18 | 7 | 5 |
| 68 | 18 | 8 | 5 |
| 69 | 18 | 9 | 6 |
| 70 | 18 | 10 | 5 |
| 71 | 19 | 8 | 4 |
| 72 | 19 | 9 | 5 |
| 73 | 19 | 8 | 6 |
| 74 | 19 | 9 | 6 |
| 75 | 19 | 10 | 6 |
| 76 | 20 | 6 | 3 |
| 77 | 20 | 7 | 3 |
| 78 | 20 | 8 | 3 |
| 79 | 20 | 9 | 6 |
| 80 | 20 | 10 | 6 |
| 81 | 20 | 11 | 6 |
| 82 | 21 | 6 | 3 |
| 83 | 21 | 8 | 3 |
| 84 | 21 | 9 | 6 |
| 85 | 21 | 10 | 6 |
| 86 | 21 | 11 | 4 |
| 87 | 22 | 5 | 3 |
| 88 | 22 | 7 | 4 |
| 89 | 22 | 8 | 6 |
| 90 | 22 | 10 | 6 |
| 91 | 22 | 10 | 7 |
| 92 | 22 | 11 | 7 |
| 93 | 23 | 8 | 3 |
| 94 | 23 | 7 | 6 |
| 95 | 23 | 9 | 6 |
| 96 | 23 | 10 | 6 |
| 97 | 23 | 11 | 6 |
| 98 | 23 | 12 | 6 |
| 99 | 24 | 8 | 4 |
| 100 | 24 | 8 | 4 |

3995-4095 GRADATION

| | P1 | P2 | P3 |
|---|---|---|---|
| 3995 | 255 | 246 | 36 |
| 3996 | 255 | 246 | 41 |
| 3997 | 255 | 246 | 45 |
| 3998 | 255 | 246 | 48 |
| 3999 | 255 | 246 | 51 |
| 4000 | 255 | 246 | 54 |
| 4001 | 255 | 246 | 56 |
| 4002 | 255 | 246 | 59 |
| 4003 | 255 | 246 | 61 |
| 4004 | 255 | 246 | 62 |
| 4005 | 255 | 247 | 58 |
| 4006 | 255 | 247 | 59 |
| 4007 | 255 | 247 | 61 |
| 4008 | 255 | 247 | 48 |
| 4009 | 255 | 247 | 49 |
| 4010 | 255 | 247 | 51 |
| 4011 | 255 | 247 | 54 |
| 4012 | 255 | 247 | 56 |
| 4013 | 255 | 247 | 58 |
| 4014 | 255 | 247 | 60 |
| 4015 | 255 | 247 | 62 |
| 4016 | 255 | 248 | 59 |
| 4017 | 255 | 248 | 38 |
| 4018 | 255 | 248 | 40 |
| 4019 | 255 | 248 | 44 |
| 4020 | 255 | 248 | 46 |
| 4021 | 255 | 248 | 51 |
| 4022 | 255 | 248 | 54 |
| 4023 | 255 | 248 | 56 |
| 4024 | 255 | 248 | 58 |
| 4025 | 255 | 248 | 59 |
| 4026 | 255 | 248 | 62 |
| 4027 | 255 | 249 | 34 |
| 4028 | 255 | 249 | 33 |
| 4029 | 255 | 249 | 38 |
| 4030 | 255 | 249 | 44 |
| 4031 | 255 | 249 | 47 |
| 4032 | 255 | 249 | 50 |
| 4033 | 255 | 249 | 53 |
| 4034 | 255 | 249 | 55 |
| 4035 | 255 | 249 | 58 |
| 4036 | 255 | 249 | 60 |
| 4037 | 255 | 249 | 62 |
| 4038 | 255 | 250 | 13 |
| 4039 | 255 | 250 | 31 |
| 4040 | 255 | 250 | 38 |
| 4041 | 255 | 250 | 43 |
| 4042 | 255 | 250 | 46 |
| 4043 | 255 | 250 | 50 |
| 4044 | 255 | 250 | 53 |
| 4045 | 255 | 250 | 55 |
| 4046 | 255 | 250 | 58 |
| 4047 | 255 | 250 | 60 |
| 4048 | 255 | 250 | 61 |
| 4049 | 255 | 250 | 63 |
| 4050 | 255 | 251 | 29 |
| 4051 | 255 | 251 | 34 |
| 4052 | 255 | 251 | 41 |
| 4053 | 255 | 251 | 46 |
| 4054 | 255 | 251 | 49 |
| 4055 | 255 | 251 | 52 |
| 4056 | 255 | 251 | 55 |
| 4057 | 255 | 251 | 57 |
| 4058 | 255 | 251 | 59 |
| 4059 | 255 | 251 | 61 |
| 4060 | 255 | 251 | 63 |
| 4061 | 255 | 252 | 24 |
| 4062 | 255 | 252 | 34 |
| 4063 | 255 | 252 | 40 |
| 4064 | 255 | 252 | 44 |
| 4065 | 255 | 252 | 46 |
| 4066 | 255 | 252 | 51 |
| 4067 | 255 | 252 | 53 |
| 4068 | 255 | 252 | 56 |
| 4069 | 255 | 252 | 58 |
| 4070 | 255 | 252 | 60 |
| 4071 | 255 | 252 | 62 |
| 4072 | 255 | 253 | 13 |
| 4073 | 255 | 253 | 30 |
| 4074 | 255 | 253 | 37 |
| 4075 | 255 | 253 | 43 |
| 4076 | 255 | 253 | 46 |
| 4077 | 255 | 253 | 49 |
| 4078 | 255 | 253 | 52 |
| 4079 | 255 | 253 | 55 |
| 4080 | 255 | 253 | 57 |
| 4081 | 255 | 253 | 59 |
| 4082 | 255 | 253 | 61 |
| 4083 | 255 | 253 | 63 |
| 4084 | 255 | 254 | 16 |
| 4085 | 255 | 254 | 34 |
| 4086 | 255 | 254 | 40 |
| 4087 | 255 | 254 | 44 |
| 4088 | 255 | 254 | 48 |
| 4089 | 255 | 254 | 51 |
| 4090 | 255 | 254 | 54 |
| 4091 | 255 | 254 | 56 |
| 4092 | 255 | 254 | 58 |
| 4093 | 255 | 254 | 60 |
| 4094 | 255 | 254 | 62 |
| 4095 | 255 | 255 | 0 |

FIG.9

0-100 GRADATION

| | P1 | P2 | P3 |
|---|---|---|---|
| 0 | 0 | 0 | 0 |
| 1 | 0 | 0 | 1 |
| 2 | 1 | 1 | 1 |
| 3 | 1 | 1 | 1 |
| 4 | 1 | 1 | 1 |
| 5 | 1 | 1 | 1 |
| 6 | 2 | 2 | 2 |
| 7 | 2 | 2 | 2 |
| 8 | 2 | 2 | 2 |
| 9 | 2 | 2 | 2 |
| 10 | 2 | 2 | 2 |
| 11 | 2 | 2 | 2 |
| 12 | 2 | 2 | 2 |
| 13 | 2 | 2 | 2 |
| 14 | 2 | 2 | 2 |
| 15 | 2 | 2 | 2 |
| 16 | 2 | 2 | 2 |
| 17 | 2 | 2 | 2 |
| 18 | 2 | 2 | 1 |
| 19 | 2 | 2 | 2 |
| 20 | 2 | 2 | 2 |
| 21 | 2 | 2 | 2 |
| 22 | 2 | 2 | 4 |
| 23 | 2 | 2 | 2 |
| 24 | 2 | 2 | 2 |
| 25 | 2 | 2 | 4 |
| 26 | 10 | 2 | 1 |
| 27 | 10 | 4 | 3 |
| 28 | 10 | 6 | 4 |
| 29 | 10 | 8 | 4 |
| 30 | 10 | 2 | 2 |
| 31 | 10 | 2 | 2 |
| 32 | 10 | 4 | 4 |
| 33 | 10 | 7 | 2 |
| 34 | 12 | 4 | 0 |
| 35 | 12 | 6 | 4 |
| 36 | 12 | 8 | 4 |
| 37 | 12 | 7 | 2 |
| 38 | 12 | 4 | 2 |
| 39 | 12 | 6 | 4 |
| 40 | 12 | 7 | 2 |
| 41 | 12 | 7 | 2 |
| 42 | 14 | 2 | 2 |
| 43 | 14 | 4 | 2 |
| 44 | 14 | 7 | 2 |
| 45 | 14 | 8 | 2 |
| 46 | 14 | 2 | 2 |
| 47 | 14 | 6 | 4 |
| 48 | 14 | 7 | 2 |
| 49 | 14 | 8 | 4 |
| 50 | 16 | 2 | 2 |
| 51 | 16 | 4 | 2 |
| 52 | 16 | 7 | 2 |
| 53 | 16 | 8 | 2 |
| 54 | 16 | 9 | 2 |
| 55 | 17 | 2 | 2 |
| 56 | 17 | 4 | 2 |
| 57 | 17 | 7 | 2 |
| 58 | 17 | 8 | 2 |
| 59 | 17 | 9 | 0 |
| 60 | 18 | 4 | 4 |
| 61 | 18 | 7 | 4 |
| 62 | 18 | 8 | 2 |
| 63 | 18 | 9 | 2 |
| 64 | 18 | 10 | 2 |
| 65 | 18 | 6 | 4 |
| 66 | 18 | 8 | 2 |
| 67 | 18 | 8 | 4 |
| 68 | 18 | 10 | 4 |
| 69 | 20 | 3 | 2 |
| 70 | 20 | 7 | 0 |
| 71 | 20 | 8 | 2 |
| 72 | 20 | 9 | 0 |
| 73 | 20 | 10 | 0 |
| 74 | 21 | 4 | 2 |
| 75 | 21 | 7 | 4 |
| 76 | 21 | 8 | 0 |
| 77 | 21 | 10 | 2 |
| 78 | 21 | 10 | 2 |
| 79 | 22 | 4 | 2 |
| 80 | 22 | 7 | 2 |
| 81 | 22 | 8 | 2 |
| 82 | 22 | 10 | 2 |
| 83 | 22 | 11 | 2 |
| 84 | 22 | 4 | 2 |
| 85 | 22 | 7 | 2 |
| 86 | 22 | 8 | 4 |
| 87 | 22 | 10 | 2 |
| 88 | 22 | 11 | 2 |
| 89 | 24 | 2 | 2 |
| 90 | 24 | 7 | 4 |
| 91 | 24 | 8 | 4 |
| 92 | 24 | 10 | 6 |
| 93 | 24 | 11 | 6 |
| 94 | 24 | 12 | 6 |
| 95 | 26 | 8 | 6 |
| 96 | 26 | 8 | 6 |
| 97 | 26 | 10 | 6 |
| 98 | 26 | 11 | 6 |
| 99 | 26 | 12 | 6 |
| 100 | 26 | 8 | 4 |

3995-4095 GRADATION

| | P1 | P2 | P3 |
|---|---|---|---|
| 3995 | 255 | 255 | 241 |
| 3996 | 255 | 255 | 241 |
| 3997 | 255 | 255 | 241 |
| 3998 | 255 | 255 | 242 |
| 3999 | 255 | 255 | 242 |
| 4000 | 255 | 255 | 242 |
| 4001 | 255 | 255 | 242 |
| 4002 | 255 | 255 | 242 |
| 4003 | 255 | 255 | 242 |
| 4004 | 255 | 255 | 242 |
| 4005 | 255 | 255 | 243 |
| 4006 | 255 | 255 | 243 |
| 4007 | 255 | 255 | 243 |
| 4008 | 255 | 255 | 243 |
| 4009 | 255 | 255 | 243 |
| 4010 | 255 | 255 | 243 |
| 4011 | 255 | 255 | 243 |
| 4012 | 255 | 255 | 244 |
| 4013 | 255 | 255 | 244 |
| 4014 | 255 | 255 | 244 |
| 4015 | 255 | 255 | 244 |
| 4016 | 255 | 255 | 244 |
| 4017 | 255 | 255 | 244 |
| 4018 | 255 | 255 | 244 |
| 4019 | 255 | 255 | 244 |
| 4020 | 255 | 255 | 245 |
| 4021 | 255 | 255 | 245 |
| 4022 | 255 | 255 | 245 |
| 4023 | 255 | 255 | 245 |
| 4024 | 255 | 255 | 245 |
| 4025 | 255 | 255 | 245 |
| 4026 | 255 | 255 | 246 |
| 4027 | 255 | 255 | 246 |
| 4028 | 255 | 255 | 246 |
| 4029 | 255 | 255 | 246 |
| 4030 | 255 | 255 | 246 |
| 4031 | 255 | 255 | 246 |
| 4032 | 255 | 255 | 246 |
| 4033 | 255 | 255 | 247 |
| 4034 | 255 | 255 | 247 |
| 4035 | 255 | 255 | 247 |
| 4036 | 255 | 255 | 247 |
| 4037 | 255 | 255 | 247 |
| 4038 | 255 | 255 | 247 |
| 4039 | 255 | 255 | 247 |
| 4040 | 255 | 255 | 248 |
| 4041 | 255 | 255 | 248 |
| 4042 | 255 | 255 | 248 |
| 4043 | 255 | 255 | 248 |
| 4044 | 255 | 255 | 248 |
| 4045 | 255 | 255 | 248 |
| 4046 | 255 | 255 | 248 |
| 4047 | 255 | 255 | 249 |
| 4048 | 255 | 255 | 249 |
| 4049 | 255 | 255 | 249 |
| 4050 | 255 | 255 | 249 |
| 4051 | 255 | 255 | 249 |
| 4052 | 255 | 255 | 249 |
| 4053 | 255 | 255 | 249 |
| 4054 | 255 | 255 | 249 |
| 4055 | 255 | 255 | 250 |
| 4056 | 255 | 255 | 250 |
| 4057 | 255 | 255 | 250 |
| 4058 | 255 | 255 | 250 |
| 4059 | 255 | 255 | 250 |
| 4060 | 255 | 255 | 250 |
| 4061 | 255 | 255 | 250 |
| 4062 | 255 | 255 | 251 |
| 4063 | 255 | 255 | 251 |
| 4064 | 255 | 255 | 251 |
| 4065 | 255 | 255 | 251 |
| 4066 | 255 | 255 | 251 |
| 4067 | 255 | 255 | 251 |
| 4068 | 255 | 255 | 251 |
| 4069 | 255 | 255 | 252 |
| 4070 | 255 | 255 | 252 |
| 4071 | 255 | 255 | 252 |
| 4072 | 255 | 255 | 252 |
| 4073 | 255 | 255 | 252 |
| 4074 | 255 | 255 | 252 |
| 4075 | 255 | 255 | 252 |
| 4076 | 255 | 255 | 252 |
| 4077 | 255 | 255 | 253 |
| 4078 | 255 | 255 | 253 |
| 4079 | 255 | 255 | 253 |
| 4080 | 255 | 255 | 253 |
| 4081 | 255 | 255 | 253 |
| 4082 | 255 | 255 | 253 |
| 4083 | 255 | 255 | 253 |
| 4084 | 255 | 255 | 253 |
| 4085 | 255 | 255 | 254 |
| 4086 | 255 | 255 | 254 |
| 4087 | 255 | 255 | 254 |
| 4088 | 255 | 255 | 254 |
| 4089 | 255 | 255 | 254 |
| 4090 | 255 | 255 | 254 |
| 4091 | 255 | 255 | 254 |
| 4092 | 255 | 255 | 255 |
| 4093 | 255 | 255 | 255 |
| 4094 | 255 | 255 | 255 |
| 4095 | 255 | 255 | 255 |

FIG.13A

| | | |
|---|---|---|
| $RP_1$ | $GP_1$ | $BP_1$ |
| $RP_2$ | $GP_2$ | $BP_2$ |
| $RP_3$ | $GP_3$ | $BP_3$ |

LIQUID CRYSTAL DISPLAY DEVICE

BACKGROUND OF THE INVENTION

1. Field of the Invention

The invention relates to a liquid crystal display device, and more particularly to a liquid crystal display device which divides a pixel into a plurality of sub-pixels for displaying images in multi-gradation.

2. Description of the Related Art

As a method of displaying images in multi-gradation in a liquid crystal display device, there is known a method of dividing a pixel into a plurality of sub-pixels.

An example of such a method is suggested in Japanese Unexamined Patent Publication No. 2001-34232 (A).

FIG. 1 is a block diagram of a liquid crystal display device 200 suggested in the Publication.

The liquid crystal display device 200 is comprised of a color liquid crystal panel 212, a backlight unit 214, a data processor 216, a driver 218 for driving the color liquid crystal panel 212, and an interface (IF) 222.

FIG. 2A is a partially enlarged view of a display screen of the color liquid crystal panel 212.

As illustrated in FIG. 2A, R, G and B pixels are horizontally arranged in this order in a display screen of the color liquid crystal panel 212 in accordance with a color filter. Colored images are displayed by R, G and B image data through those R, G and B pixels. Black-and-white image is displayed in the liquid crystal display device 200 as follows.

In the liquid crystal display device 200, black-and-white image is displayed with R, G and B pixels being used as a single unit pixel. Since a unit pixel is comprised of R, G and B pixels, the number of brightness displayable in a unit pixel is three times greater than the number of brightness displayable in each of R, G and B pixels.

In other words, a gradation in a displayed image can be made smaller by setting a range between the above-mentioned brightnesses into one-third.

For instance, it is assumed that a unit pixel P is divided into three sub-pixels p1, p2 and p3, as illustrated in FIG. 2B. If each of the sub-pixels p1, p2 and p3 displays images in eight bits, a displayable brightness in each of the sub-pixels p1, p2 and p3 is in the range of 0 to 255 both inclusive, and a displayable brightness in the unit pixel P is in the range of 0 to 765 (255×3) both inclusive. Among the displayable brightness, the minimum brightness 0 is associated with a minimum among image data, and the maximum brightness 765 is associated with a maximum among image data. This ensures that images are displayed with high gradation.

When the data processor 216 supplies a brightness converted from image data, to the unit pixel P, the data processor 216 distributes the brightness almost equally to the sub-pixels p1, p2 and p3.

Specifically, assuming that 8-bit image data is input into a color display unit which displays images in 8-bit, the image data consists of 0 to 255, and a minimum 0 among the image data is associated with a minimum brightness 0 of the color display unit, and a maximum 255 among the image data is associated with a maximum brightness 765 of the color display unit.

Then, the data processor 216 distributes a brightness obtained based on the image data, to the sub-pixels p1, p2 and p3 in accordance with Table 1 shown below. For instance, when a brightness is equal to 0, (0, 0, 0) is assigned to the sub-pixels p1, p2 and p3, when a brightness is equal to 1, (0, 0, 1) is assigned to the sub-pixels p1, p2 and p3, and when a brightness is equal to 2, (0, 1, 1) is assigned to the sub-pixels p1, p2 and p3. The assignment of a brightness to the sub-pixels p1, p2 and p3 is carried out in the same way for a brightness 0 to 765.

TABLE 1

| Brightness | Sub-pixel p1 | Sub-pixel p2 | Sub-pixel p3 |
|---|---|---|---|
| 0 | 0 | 0 | 0 |
| 1 | 0 | 0 | 1 |
| 2 | 0 | 1 | 1 |
| 3 | 1 | 1 | 1 |
| 4 | 1 | 1 | 2 |
| 5 | 1 | 2 | 2 |
| . | . | . | . |
| . | . | . | . |
| . | . | . | . |
| 762 | 254 | 254 | 254 |
| 763 | 254 | 254 | 255 |
| 764 | 254 | 255 | 255 |
| 765 | 255 | 255 | 255 |

In Table 1, a brightness indicates a gradation to be input into the liquid crystal display device 200.

As illustrated in FIG. 2B, in the liquid crystal display device 200, a pixel is divided into the sub-pixels p1, p2 and p3 which are equal to one another, and the number of gradation is made about three times greater by summing gradation (data to be input into a driver) of the sub-pixels p1, p2 and p3.

Specifically, as illustrated in FIG. 3, input gradation in the liquid crystal display device 200 (that is, data to be input into a driver of each of the sub-pixels) and a brightness which is shown as a standardized brightness in FIG. 3 have a linear relation to each other. Accordingly, a sum of brightness of the sub-pixels p1, p2 and p3 is equal to a brightness of the pixel P.

However, since gradation to be input into the sub-pixels p1, p2 and p3 and brightness of the sub-pixels p1, p2 and p3 are designed to have a linear relation to each other, the number of gradation which the pixel P can accomplish is equal at maximum to 3M wherein M indicates the number of gradation which each of the sub-pixels p1, p2 and p3 can accomplish.

For instance, if each of the sub-pixels p1, p2 and p3 can accomplish 256 gradation, the pixel P consisting of the sub-pixels p1, p2 and p3 could accomplish 766 gradation.

Accordingly, it is not always possible for the conventional liquid crystal display device 200 to display images in desired multi-gradation.

Frame rate control (FRC) makes it possible to display images in desired multi-gradation.

Herein, in accordance with frame rate control, for instance, 10-bit image data is divided into four 8-bit image data, and the thus divided 8-bit image data is successively displayed at an increased frequency. This results in that image data is displayed in 10-bit.

Though multi-gradation can be readily accomplished by frame rate control, frame rate control is accompanied with a problem that flicker much occurs in images displayed in accordance with frame rate control.

Frame rate control is accompanied further with a problem that when frame rate control is carried out at a longer period than a displayed-frame rate, it would not be possible to display moving images in subtle colors or to properly display images in additional gradation.

In order to eliminate flicker, or in order to properly display moving images in designed colors, it would be necessary to raise a frame frequency to switch displaying images at a high rate. However, it is difficult to switch image-displaying at a high rate, because a driver IC of a monitor or a monitor itself has a limited response rate.

SUMMARY OF THE INVENTION

In view of the above-mentioned problems in the conventional liquid crystal display device, it is an object of the present invention to provide a liquid crystal display device which is capable of displaying images at desired multi-gradation without carrying out frame rate control.

In one aspect of the present invention, there is provided a liquid crystal display device which divides a pixel into a plurality of sub-pixels, wherein a gradation and a brightness in each of the sub-pixels have a non-linear relation to each other, and a desired brightness for the pixel is selected by selecting a gradation in each of the sub-pixels.

In the liquid crystal display device in accordance with the present invention, a pixel is divided into a plurality of sub-pixels, and a gradation and a brightness in each of the sub-pixels are designed to have a non-linear relation to each other. In the conventional liquid crystal display device, as illustrated in FIG. 3, a gradation and a brightness in each of the sub-pixels were designed to have a linear relation to each other. Accordingly, when input gradation increases by one unit, a brightness increases by a uniform degree in association with an increase in input gradation. In contrast, in the liquid crystal display device in accordance with the present invention, as illustrated in FIG. 5 later, a gradation and a brightness in each of the sub-pixels are designed to have a non-linear relation to each other. Accordingly, when input gradation increases by one unit, various non-uniform increases in a brightness can be accomplished. Hence, it would be possible to accomplish a desired brightness in a pixel by selecting necessary increases in a brightness in each of the sub-pixels, and summing them. Thus, the liquid crystal display device in accordance with the present invention makes it possible to display images at a desired multi-gradation.

The liquid crystal display device may further include a memory storing therein a relation between a gradation and a brightness in each of the sub-pixels.

By designing the liquid crystal display device to include a memory, it is possible to store a determined relation between a gradation and a brightness, and read a relation between a gradation and a brightness, having been determined previously, out of the memory.

The relation in each of the sub-pixels may be expressed as a table, in which case, the memory stores the table therein.

The liquid crystal display device may further include a computing unit which computes the relation in each of the sub-pixels, and transmits the thus computed relation to a source driver.

For instance, if the computing unit computes the relation at real time, it is not always necessary to store the computed relation in the memory. Since a source driver has a function of storing gradation data serially transmitted thereto, a source driver stores the computed relation transmitted from the computing unit.

It is preferable that the computing unit computes the relation in each of the sub-pixels through the use of a specific algorithm.

The liquid crystal display device may further include a computing device which computes a gradation associated with each of the sub-pixels in dependence on a gradation of input data.

A gamma (γ) for each of the sub-pixels may be designed to be greater than a gamma (γ) for the pixel.

It is preferable that a drive voltage associated with input data is concurrently applied to the sub-pixels.

A sum of a maximum brightness in each of the sub-pixels may be designed to be equal to a brightness associated with a maximum gradation of the pixel.

The advantages obtained by the aforementioned present invention will be described hereinbelow.

In accordance with the present invention, it is possible to display images in multi-gradation without carrying out frame rate control. For instance, the present invention makes it possible to display images in 12 bits (4096 gradation) through the use of a conventional 8-bit driver.

For instance, when a pixel is divided into three sub-pixels, the number of drivers necessary for driving the sub-pixels would be three times greater than the number of drivers necessary for driving the pixel. However, an increase in hardware is smaller in the division of a pixel to the sub-pixels than in a case wherein a digital-analog converter in a source driver is designed sixteen times greater in circuit size.

The above and other objects and advantageous features of the present invention will be made apparent from the following description made with reference to the accompanying drawings, in which like reference characters designate the same or similar parts throughout the drawings.

BRIEF DESCRIPTION OF THE DRAWINGS

FIG. 6 illustrates a part of a map (8 bits) used for converting input gradation (12 bits) to a brightness in each of sub-pixels in the liquid crystal display device in accordance with the first embodiment of the present invention.

FIG. 9 illustrates a part of a map (8 bits) used for converting input gradation (12 bits) to a brightness in each of sub-pixels in the liquid crystal display device illustrated in FIG. 8.

FIG. 13A is a plan view of sub-pixels divided from the color pixel illustrated in FIG. 12A.

DESCRIPTION OF THE PREFERRED EMBODIMENTS

Preferred embodiments in accordance with the present invention will be explained hereinbelow with reference to drawings.

Figure 1:
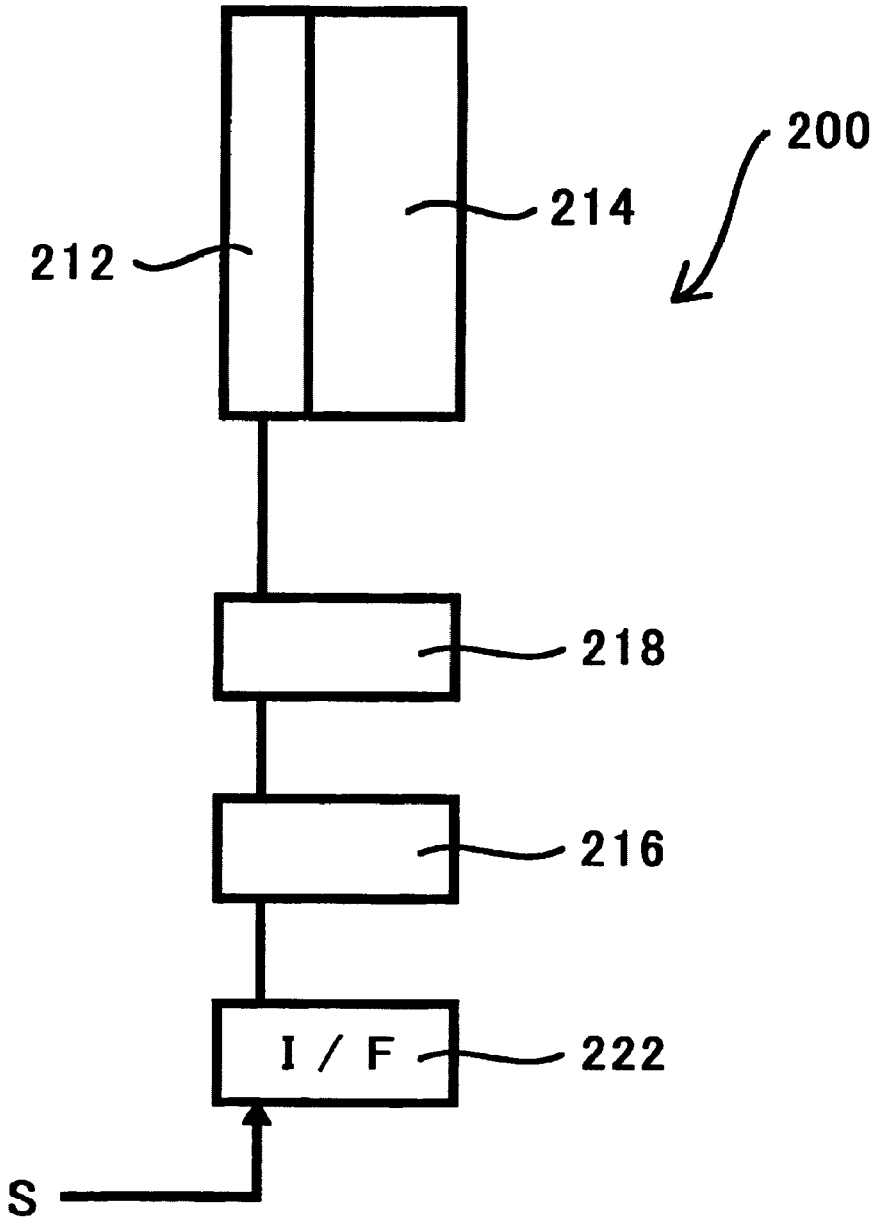
FIG.1 PRIOR ART
FIG. 1 is a block diagram of a conventional liquid crystal display device.
Figure 2A:
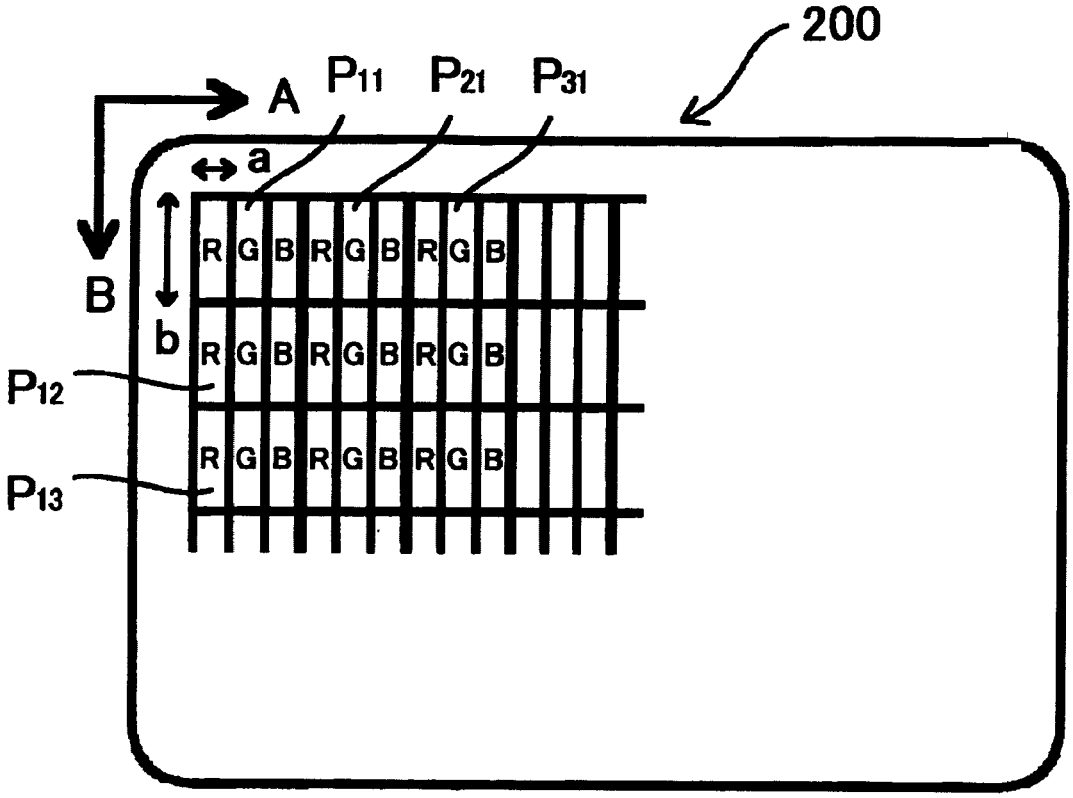
FIG.2A PRIOR ART
FIG. 2A is a partially enlarged view of a display screen of a color liquid crystal panel in the liquid crystal display device illustrated in FIG. 1.
Figure 2B:
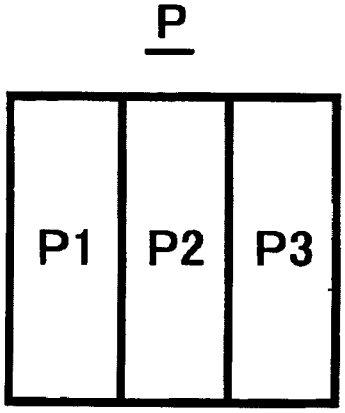
FIG.2B PRIOR ART
FIG. 2B illustrates three sub-pixels P1, P2 and P3 divided from a pixel P.
Figure 3:
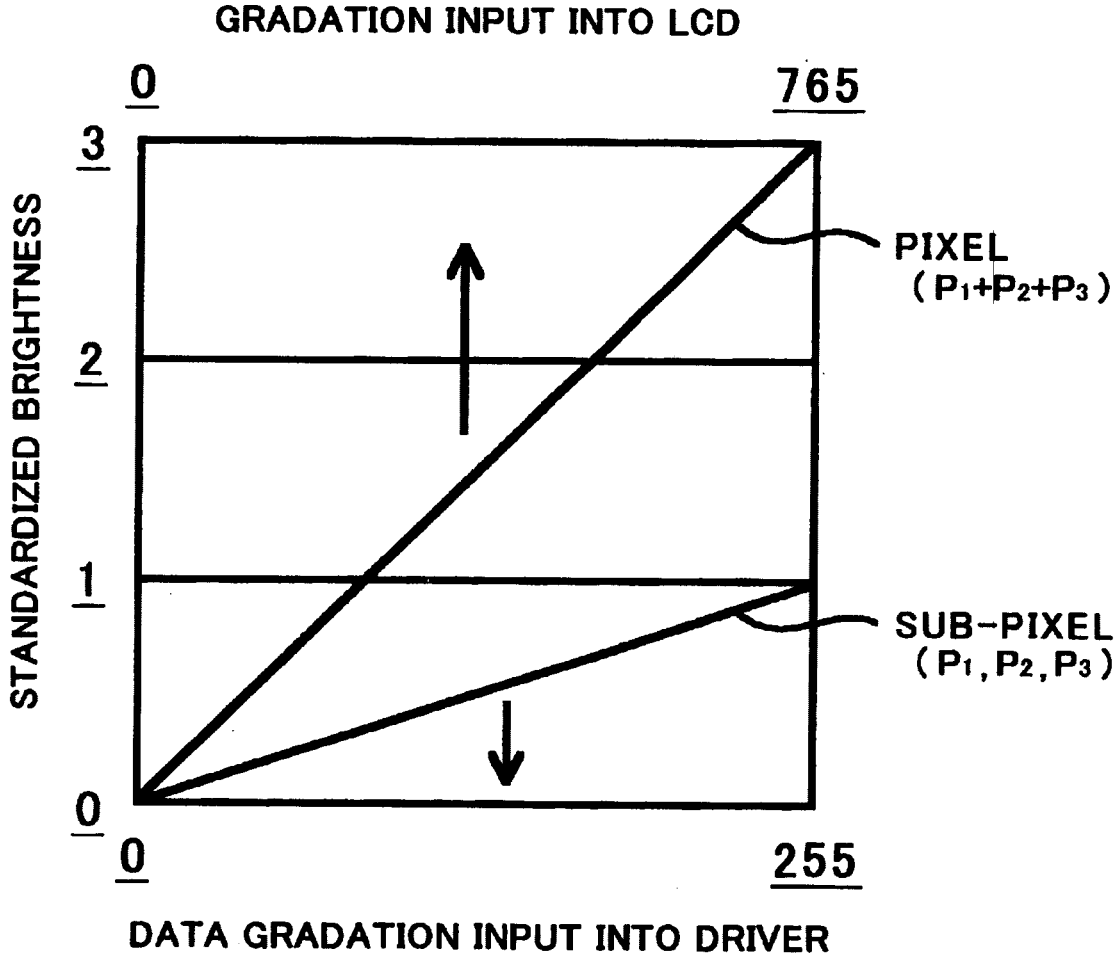
FIG.3 PRIOR ART
FIG. 3 is a graph showing a relation between a gradation and a brightness in the liquid crystal display device illustrated in FIG. 1.
Figure 4:
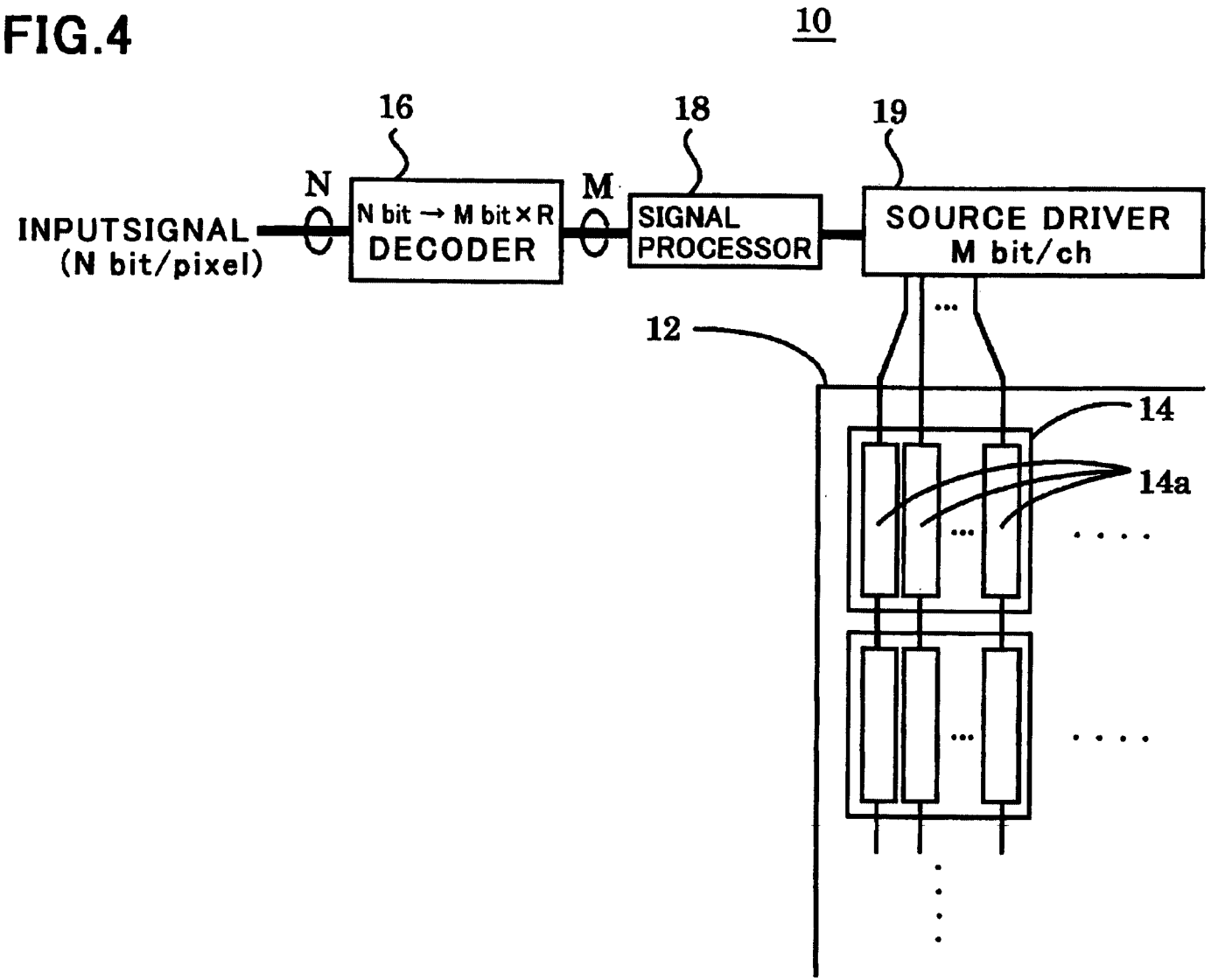
FIG. 4 is a block diagram of a liquid crystal display device in accordance with the first embodiment of the present invention.

FIG. 4 is a block diagram of a liquid crystal display device 10 in accordance with the first embodiment of the present invention.

The liquid crystal display device 10 is comprised of a liquid crystal panel 12 having a plurality of pixels 14 arranged in a matrix, a decoder 16 receiving an input signal, a signal processor 18 receiving decoded signals from the decoder 16 and processing them, and a source driver 19 electrically connected to both the signal processor 18 and each of the pixels 14 arranged in the liquid crystal panel 12.

As illustrated in FIG. 4, each of the pixels 14 is divided into R sub-pixels 14*a* wherein R is an integer equal to or greater than 2.

The decoder 16 converts an N-bit input signal into R M-bit sub-pixel signals. Herein, N means the number of bits of gradation data per a unit pixel in the input signal. For instance, N is equal to 8, 10, 12 or 16. In the first embodiment, N is designed equal to 12. M means the number of bits per a sub-pixel in the source driver 19. In the first embodiment, M is designed equal to 8. R means the number of sub-pixels in a pixel.

In the first embodiment, the decoder 16 is comprised of a logic circuit, such as a read only memory (ROM) or a random access memory (RAM) alone or in combination, which receives an N-bit input gradation signal as an address, and outputs a M×R-bit signal.

As mentioned later, the logic circuit constituting the decoder 16 includes a table by which a brightness of each of the sub-pixels 14*a* is determined so as to allow the pixel 14 to have a desired brightness.

A drive voltage associated with the input data is concurrently applied to each of the sub-pixels 14*a*.

The signal processor 18 transmits a drive signal to the source driver 19 to properly drive the source driver 19. The signal processor 18 successively transmits drive signals associated with the sub-pixels 14*a*, to the source driver 19 in accordance with a clock signal having a frequency which is R tines greater than a clock frequency of the input signal.

As the signal processor 18 and the source driver 19, a signal processor and a source driver both used in a conventional liquid crystal display device may be used.

Figure 5:
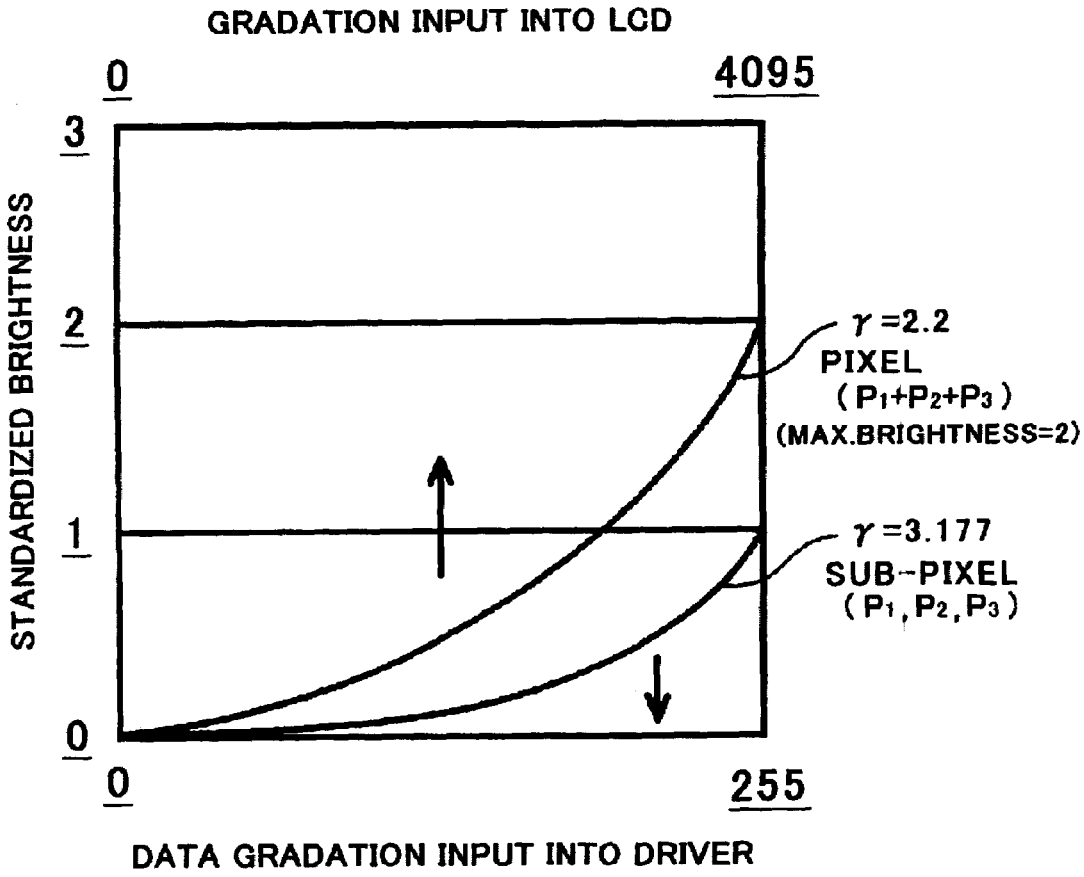
FIG. 5 is a graph showing a relation between a gradation and a brightness in the liquid crystal display device in accordance with the first embodiment of the present invention.

FIG 5 is a graph showing a relation between a gradation and a brightness in the pixel 14 in the event that the pixel 14 is divided into the three sub-pixels 14*a* (that is, R=3), and a relation between a gradation and a brightness in each of the sub-pixels 14*a*. In FIG. 5. a brightness is expressed as a standardized brightness.

A standardized brightness L is expressed in accordance with the following equation (A).

$$L=(S/S\max)\times\gamma \quad (A)$$

In the equation (A), S indicates the number of gradation and is an integer in the range of 0 and Smax both inclusive ($0 \leqq S \leqq S\max$), Smax indicates the maximum number of gradation and is an integer equal to or greater than one (1), and gamma (γ) indicates a parameter or a constant showing the relation between a gradation and a brightness.

For instance, the maximum number of gradation Smax is equal to 255 ($2^8-1$) in 8-bit gradation. The parameter gamma (γ) is usually designed to be equal to 2.2.

Each of the sub-pixels 14*a* is driven by a 8-bit driver. The relation between a gradation and a brightness in each of the sub-pixels 14*a* is expressed as a non-linear curve wherein the parameter gamma (γ) is designed to be equal to 3.177. Gradations of the sub-pixels 14*a* are combined to one another such that the parameter gamma (γ) in the pixel 14 is equal to 2.2.

In FIG. 5, the pixel 14 is designed to have a maximum brightness of 2. That is, the maximum brightness of the pixel 14 is designed to be equal to a sum of maximum brightness of two sub-pixels 14*a*.

A relation between a brightness Lp of the pixel 14 and a brightness Lsp of the sub-pixel 14*a* is expressed in accordance with the following equation (B).

$$Lp=\Sigma Lsp \quad (B)$$

A range of the brightness Lp of the pixel 14 is expressed as follows.

$$0 \leqq Lp \leqq \Sigma Lsp\ \max \quad (C)$$

Herein, "Lsp max" means a maximum brightness of each of the sub-pixels 14*a*.

As is obvious in view of the equation (B), a brightness of the pixel 14 is equal to a sum of brightness of the sub-pixels 14*a* constituting the pixel 14.

In accordance with the first embodiment, it is possible to accomplish multi-gradation without carrying out frame rate control (FRC). Specifically, it is possible to display images at a 12-bit gradation (4096 gradation) through the use of a conventional 8-bit driver.

When the pixel 14 is divided into the three sub-pixels 14*a*, the number of drivers necessary for driving the sub-pixels 14*a* would be three times greater than the number of drivers necessary for driving the pixel 14. However, an increase in hardware is smaller in the division of the pixel 14 to the sub-pixels 14*a* than in a case wherein a digital-analog converter in the source driver 19 is designed sixteen times greater in circuit size.

FIG. 6 illustrates an example of a 8-bit map used for converting input gradation (12 bits) to a brightness in each of sub-pixels 14*a* in the liquid crystal display device 10. FIG. 6 illustrates only input gradation in the range of 0 to 100 and further in the range of 3995 to 4095.

As mentioned above, the liquid crystal display device 10 in accordance with the first embodiment makes it possible to display images at a gradation beyond a gradation which the source driver 19 can accomplish. The reason is explained hereinbelow.

It is assumed hereinbelow that the pixel is comprised of the two sub-pixels 14*a*, that is, the number R is equal to two, and the sub-pixels 14*a* have the same relation between a gradation and a brightness and the same maximum brightness as each other. It is further assumed that the number of input gradation is greater than the number of gradation of the source driver 19 by two bits.

A gamma (γ) defining a relation between a gradation and a brightness in each of the sub-pixels 14*a* is designed greater than a gamma (γ) defining a relation between a gradation and a brightness in a target pixel. However, it is not always necessary for a gamma (γ) of each of the sub-pixels 14*a* to be on a gamma (γ) curve.

A gradation of each of the sub-pixels 14*a* is designed equal to a quarter ($1/4=1/2^2$) of a gradation of the target pixel.

By designing a gradation of the sub-pixel 14*a* so, it is possible to design one of the sub-pixels 14*a* to have a maximum brightness smaller than a target gradation of the pixel, and the other sub-pixels 14*a* to have a brightness close to the difference between the maximum brightness and the target gradation of the pixel. Thus, the brightness of the pair sub-pixels 14*a* is determined as a brightness of the pixel in association with the input gradation. The brightness of the sub-pixels 14*a* is stored in the decoder 16 as a table.

A detailed example of the above-mentioned case is explained hereinbelow with reference to FIG. 7.

Figure 7:
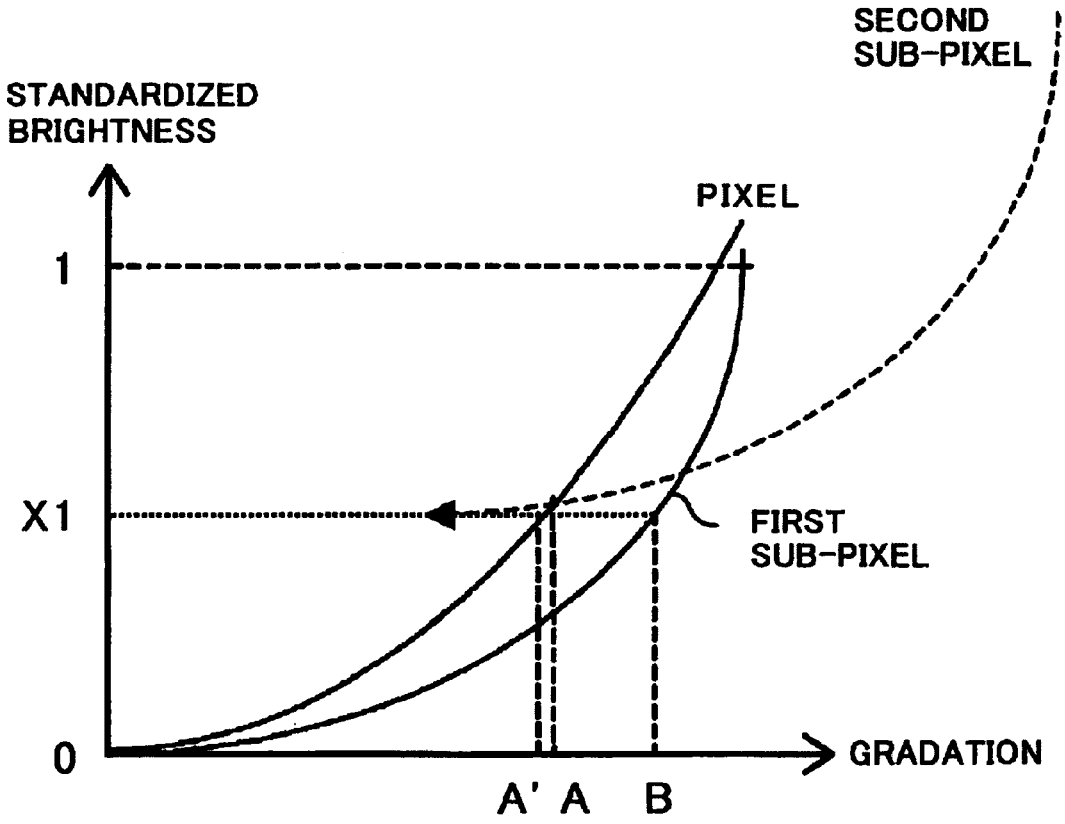
FIG. 7 is a graph showing a relation between a gradation and a standardized brightness in a pixel, a first sub-pixel and a second sub-pixel in an example of the liquid crystal display device in accordance with the first embodiment of the present invention.

FIG. 7 is a graph showing a relation between a gradation and a standardized brightness in the pixel 14, the first sub-pixel and the second sub-pixel.

A brightness associated with a gradation A of the pixel 14 is determined as follows.

First, there is determined a brightness X1 when a gradation B is assigned to the first sub-pixel. It is assumed that a brightness of the pixel 14, associated with the brightness X1, is given at a gradation A'. The gradation B, A' and A are determined such that a brightness of the pixel 14 associated with the gradation A is smaller than a brightness of the pixel 14 associated with the gradation A.

Then, a gradation is determined that gives a brightness to the second sub-pixel, which brightness is equivalent to an increase equal to an increase in a brightness of the pixel 14 associated with a difference between the gradation A and A'. Thus, a brightness of the pixel 14 is determined.

In the above-mentioned example, the above-mentioned gradation can be determined through the use of a curve having a high gamma (γ), that is, a curve having small inclination and indicative of a relation between a gradation and a brightness in the second sub-pixel. Hence, it is possible to compensate for a gradation smaller than a maximum difference in a gradation in the source driver 19.

Though a maximum brightness of the pixel 14 is designed to be twice as great as the maximum brightness of the sub-pixel 14*a* in FIG. 5, the multiple of a maximum brightness of the sub-pixel 14*a* to a maximum brightness of the pixel 14 is not to be limited to this value. The multiple of the maximum brightness may be any positive figure T equal to or smaller than the number R of the sub-pixels ($0<T\leqq R$). The figure T is not to be limited to an integer. The figure T may be a decimal.

Figure 8:
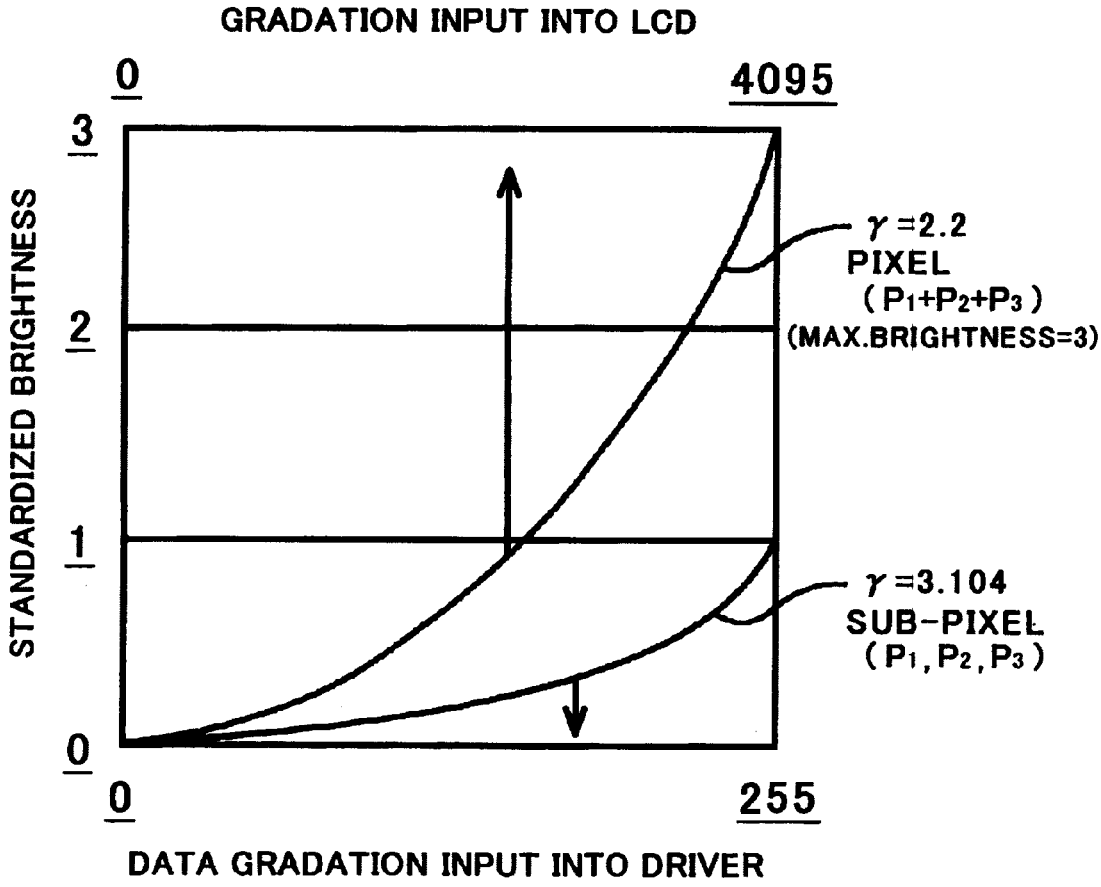
FIG. 8 is a graph showing another relation between a gradation and a brightness in the liquid crystal display device in accordance with the first embodiment of the present invention.

FIG. 8 shows a case wherein the multiple T is three. Specifically, FIG. 8 is a graph showing a relation between a gradation and a brightness in the pixel 14 and each of the sub-pixels 14*a* in the event that a maximum brightness of the pixel 14 is designed three times greater than a maximum brightness of the sub-pixel 14*a*.

Each of the sub-pixels 14*a* is driven by a 8-bit driver. The relation between a gradation and a brightness in each of the sub-pixels 14*a* is expressed as a non-linear curve wherein the parameter gamma (γ) is designed to be equal to 3.104. Gradations of the sub-pixels 14*a* are combined to one another such that the parameter gamma (γ) in the pixel 14 is equal to 2.2.

In accordance with the example illustrated in FIG. 8, similarly to the example illustrated in FIG. 5, it is possible to accomplish multi-gradation without carrying out frame rate control (FRC). Specifically, it is possible to display images at a 12-bit gradation (4096 gradation) through the use of a conventional 8-bit driver.

FIG. 9 illustrates an example of a 8-bit map used for converting input gradation (12 bits) to a brightness in each of sub-pixels 14*a*. FIG. 9 illustrates only input gradation in the range of 0 to 100 and further in the range of 3995 to 4095.

In the above-mentioned examples, a brightness of each of the sub-pixels 14*a*, associated with the input gradation, is determined through the use of the data-converting map illustrated in FIG. 6 or 9. It should be noted that a brightness of each of the sub-pixels 14*a* can be calculated without using such a data-converting map illustrated in FIG. 6 or 9.

Hereinbelow is explained a process of calculating a brightness of each of the sub-pixels 14*a*.

It is assumed that the pixel 14 is divided into the three sub-pixels 14*a*, each of the sub-pixels 14*a* is driven by a 8-bit driver (256 gradation), and the pixel 14 displays images in 12 bits (4096 gradation). It is further assumed that a relation between a gradation and a brightness in each of the sub-pixels 14*a* is defined in accordance with a gamma (γ) curve, and a maximum brightness of each of the sub-pixels 14*a* is equal to two-thirds (⅔) of a maximum brightness of the pixel 14.

A standardized brightness of the pixel 14 is expressed as Y(N). Herein, N is in the range of 0 and 4096 ($0\leqq N<4096$), and Y(N) is in the range of 0 and 3 both inclusive ($0\leqq Y(N)\leqq 2$). A brightness of each of the three sub-pixels 14*a* is expressed as Y1(N1), Y2(N2) and Y3(N3).

Assuming that a gamma (γ) is a parameter showing a relation between a gradation and a brightness in the pixel 14, Y(N) is expressed as follows.

$$Y(N)=2(N/(4096-1))^{\gamma}$$

Assuming that γsp is a parameter showing a relation between a gradation and a brightness in each of the sub-pixels 14*a*, the parameter γsp is determined such that Y(1), Y1(1), Y2(1) and Y3(1) are equal to one another (Y(1)=Y1(1)=Y2(1)=Y3(1)) in step S200.

Figure 10:
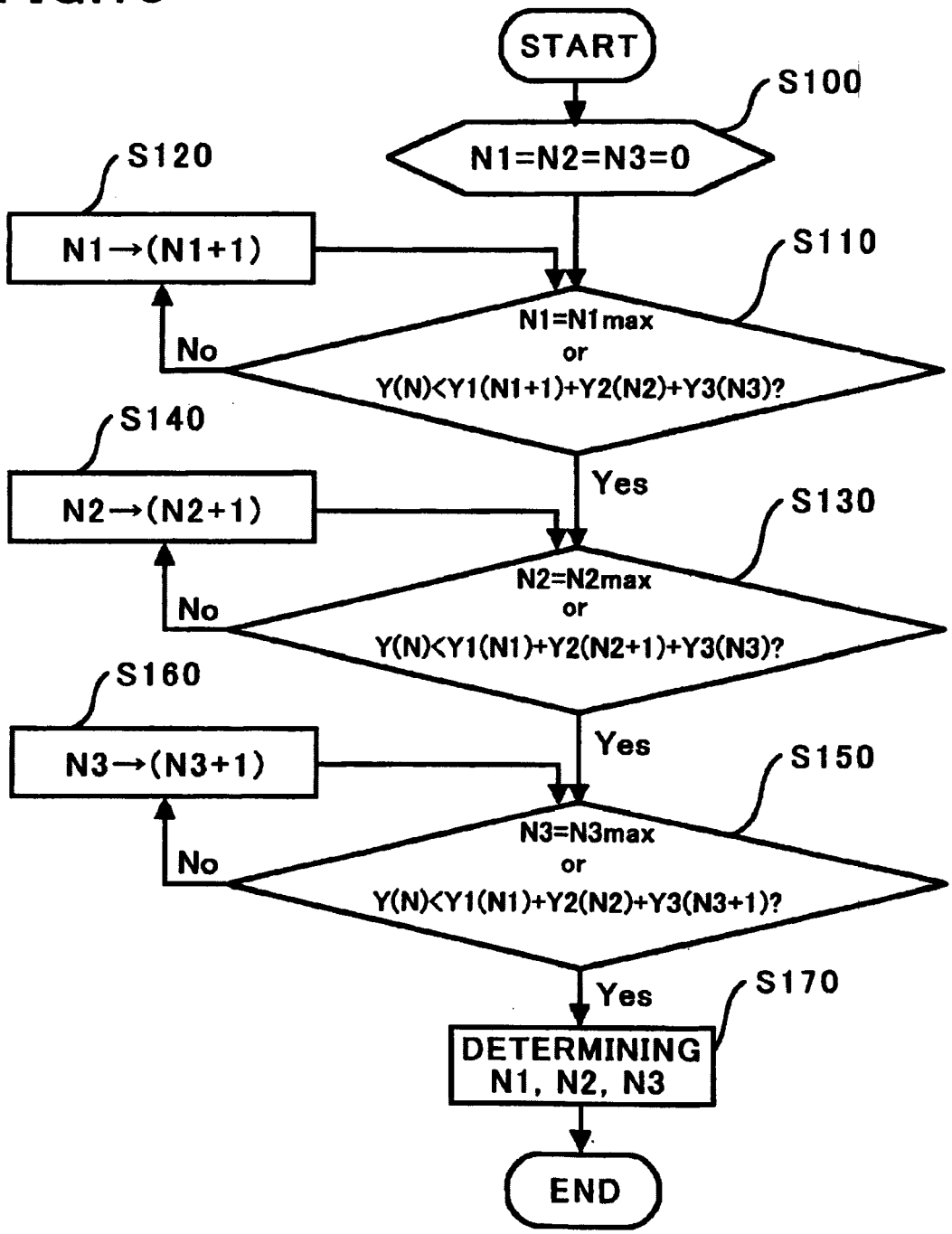
FIG. 10 is a flow chart of a first algorithm used for determining a brightness in each of sub-pixels in order to accomplish a standardized brightness of a pixel.

FIG. 10 is a flow chart showing a first algorithm used for determining Y1(N1), Y2(N2) and Y3(N3) by all of which Y(N) is determined.

First, N1, N2 and N3 are initialized. Specifically, N1, N2 and N3 are set equal to zero in step S100.

Then, there is determined any N1. For the thus determined N1, it is judged as to whether N1 is equal to a maximum N1max which is a maximum among N1, or as to whether a sum of Y1(N1+1), Y2(N2) and Y3(N3) (Y1(N1+1)+Y2(N2)+Y3(N3)) is greater than Y(N), in step S110.

If a sum of Y1(N1+1), Y2(N2) and Y2(N3) (Y1(N1+1)+Y2(N2)+Y3(N3)) is not greater than Y(N) (NO in step S110), N1 is replaced with (N1+1) in step S120. For (N1+1), it is judged again as to whether a sum of Y1(N1+1+1), Y2(N2) and Y3(N3) (Y1(N1+1+1)+Y2(N2)+Y3(N3)) is greater than Y(N), in step S110.

Steps S110 and S120 are repeatedly carried out, until a sum of Y1(N1+1), Y2(N2) and Y3(N3) (Y1(N1+1)+Y2(N2)+Y3(N3)) becomes greater than Y(N) (YES in step S110). As a result, there is determined a maximum N1 which is not over the target Y(N).

Then, there is determined any N2. For the thus determined N2, it is judged as to whether N2 is equal to a maximum N2max which is a maximum among N2, or as to whether a sum of Y1(N1), Y2(N2+1) and Y3(N3) (Y1(N1)+Y2(N2+1)+Y3(N3)) is greater than Y(N), in step S130.

If a sum of Y1(N1), Y2(N2+1) and Y3(N3) (Y1(N1)+Y2(N2+1)+Y3(N3)) is not greater than Y(N) (NO in step S130), N2 is replaced with (N2+1) in step S140. For (N2+1), it is judged again as to whether a sum of Y1(N1), Y2(N2+1+1) and Y3(N3) (Y1(N1)+Y2(N2+1)+Y3(N3)) is greater than Y(N), in step S130.

Steps S130 and S140 are repeatedly carried out, until a sum of Y1(N1), Y2(N2+1) and Y3(N3) (Y1(N1)+Y2(N2+1)+Y3(N3)) becomes greater than Y(N) (YES in step S130). As a result, there is determined a maximum N2 which is not over a difference between the target Y(N) and itself.

Then, there is determined any N3. For the thus determined N3, it is judged as to whether N3 is equal to a maximum N3max which is a maximum among N3, or as to whether a sum of Y1(N1), Y2(N2) and Y3(N3+1) (Y1(N1)+Y2(N2)+Y3(N3+1)) is greater than Y(N), in step S150.

If a sum of Y1(N1), Y2(N2) and Y3(N3+1) (Y1(N1)+Y2(N2)+Y3(N3+1)) is not greater than Y(N) (NO in step S150), N3 is replaced with (N3+1) in step S160. For (N3+1), it is judged again as to whether a sum of Y1(N1), Y2(N2) and Y3(N3+1+1) (Y1(N1)+Y2(N2)+Y3(N3+1+1)) is greater than Y(N), in step S150.

Steps S150 and S160 are repeatedly carried out, until a sum of Y1(N1), Y2(N2) and Y3(N3+1) (Y1(N1)+Y2(N2)+Y3(N3+1)) becomes greater than Y(N) (YES in stop S150). As a result, there is determined a maximum N3 which is not over a difference between the target Y(N) and itself.

Thus, there are determined all of N1, N2 and N3, in step s170.

Hereinbelow is explained a second algorithm used for determining Y1(N1), Y2(N2) and Y3(N3) by all of which Y(N) is determined.

Figure 11:
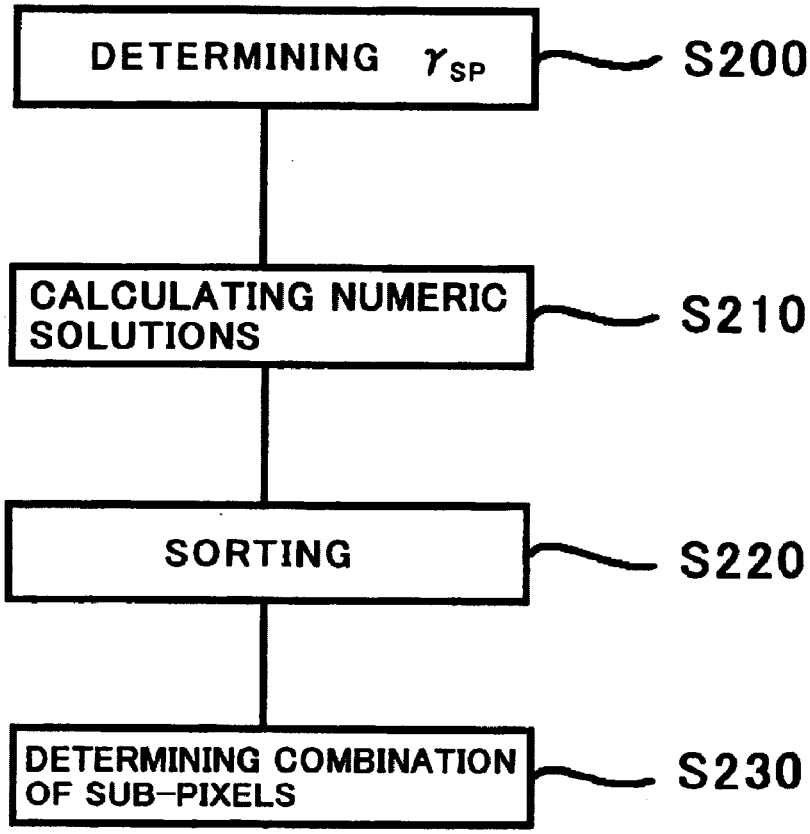
FIG. 11 is a flow chart of a second algorithm used for determining a brightness in each of sub pixels in order to accomplish a standardized brightness of a pixel.

FIG. 11 is a flow chart showing the second algorithm.

Assuming that γsp is a parameter showing a relation between a gradation and a brightness in each of the pixels 14*a*, the parameter γsp is determined such that Y(1), Y(1), Y2(1) and Y3(1) are equal to one another (Y(1)=Y1(1)=Y2(1)=Y3(1)), in step S200.

Then, all numeric solutions of the sub-pixels 14*a* are calculated, in step S210.

Then, all combinations of the sub-pixels 14*a* are sorted with a sum of the thus calculated numeric solutions, in step S220.

Then, there is determined a combination of the sub-pixels 14*a* which combination is closet to a target Y(N), in step S230.

Hereinbelow is explained a color pixel to which the above-mentioned embodiment is applied.

Figure 12A:
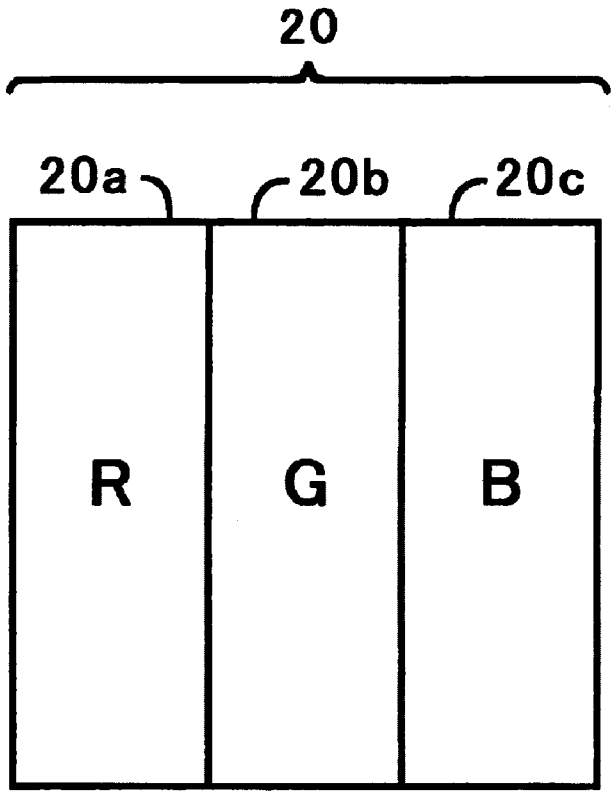
FIG. 12A is a plan view of a color pixel.

As illustrated in FIG. 12A, it is assumed that a color pixel 20 has R, G and B dots.

Figure 12B:
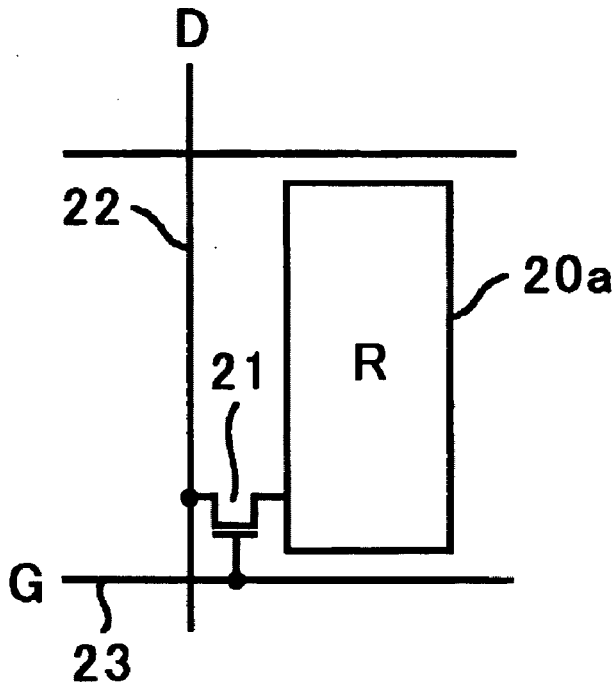
FIG. 12B is a circuit diagram showing arrangement of the color pixel illustrated in FIG. 12A.

For instance, each of the dots R, G and B in the color pixel 20 is electrically connected to a drain line 22 through a drain of a thin film transistor (TFT) 21 and to a gate line 23 through a gate of the thin film transistor 21, as illustrated in FIG. 12B.

When the above-mentioned embodiment is applied to the color pixel 20, as illustrated in FIG. 13A, the dot R is divided into three sub-dots $RP_1$, $RP_2$ and $RP_3$, the dot G is divided into three sub-dots $GP_1$, $GP_2$ and $GP_3$, and the dot B is divided into three sub-dots $BP_1$, $BP_2$ and $BP_3$.

Figure 13B:
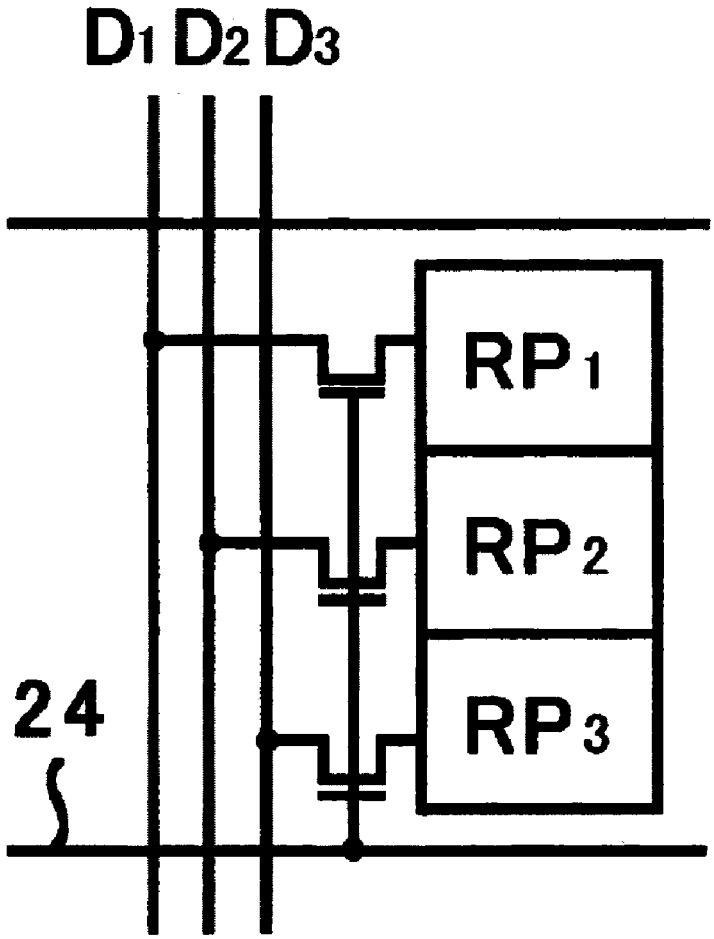
FIG. 13B is a circuit diagram showing arrangement of the sub-pixels illustrated in FIG. 13A.
Figure 13C:
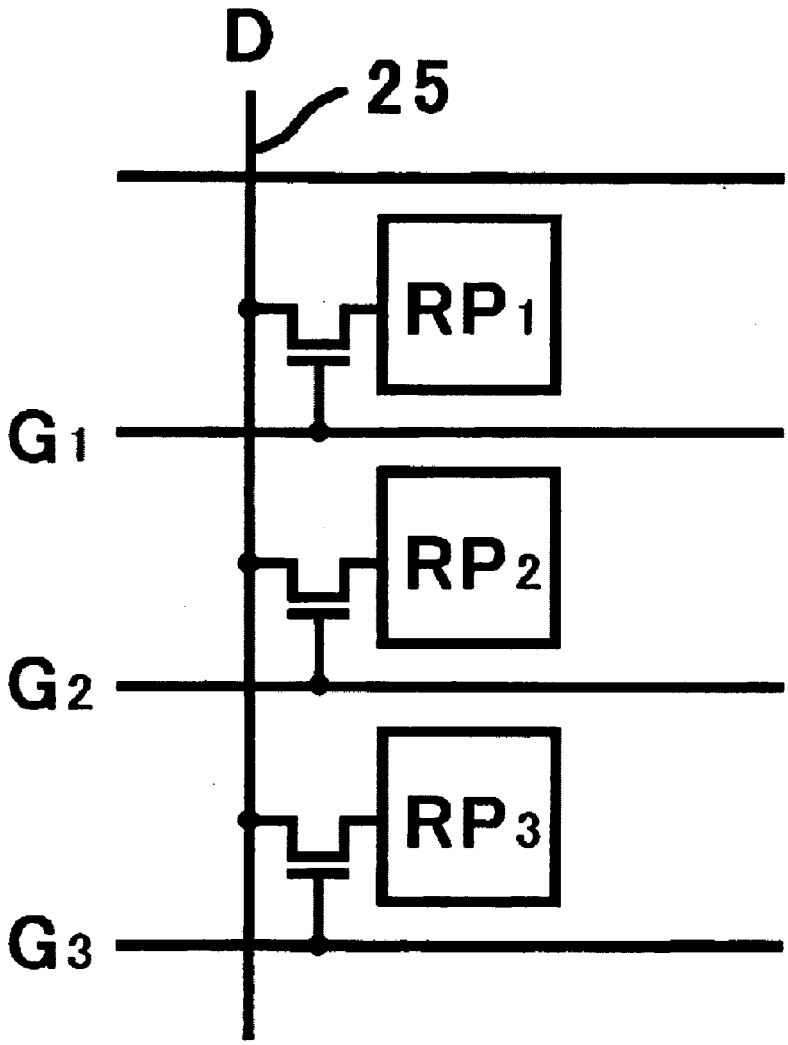
FIG. 13C is a circuit diagram showing another arrangement of the sub-pixels illustrated in FIG. 13A.

FIGS. 13B and 13C illustrate examples of arrangement of the sub-dots.

For instance, as illustrated in FIG. 13B, the three sub-dots $RP_1$, $RP_2$ and $RP_3$ divided from the dot R are electrically connected to associated drain lines $D_1$, $D_2$ and $D_3$ through drains of associated thin film transistors, and further to a common gate line 24 through gates of the associated thin film transistors.

As an alternative, as illustrated in FIG. 13C, the three sub-dots $RP_1$, $RP_2$ and $RP_3$ divided from the dot R are electrically connected to a common gate line 25 through drains of associated thin film transistors, and further to associated gate lines $G_1$, $G_2$ and $G_3$ through gates of the associated thin film transistors.

A drain signal voltage is applied in time division to each of the sub-dots $RP_1$, $RP_2$ and $RP_3$ in a line-scanning period.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2001-238406 filed on Aug. 6, 2001 including specification, claims, drawings and summary is incorporated herein by reference in its entirety.

What is claimed is:

1. A liquid crystal display (LCD) device comprising:

a decoder receiving an N-bit input gradation signal, said decoder converting said N-bit input gradation signal into a plurality of M-bit gradation signals; and a LCD having a plurality of pixels, said pixels having a plurality of sub-pixels, said LCD receiving said M-bit gradation signals, wherein a gradation and a brightness in each of said sub-pixels have a non-linear relation to each other, and a desired brightness for said pixel is selected by selecting a gradation in each of said sub-pixels, wherein N is greater than M, where N and M are positive integers, said device further comprising a memory storing therein a relation between a gradation and a brightness in each of said sub-pixels, wherein said relation in each of said sub-pixels is expressed as a table, and said memory stores said table therein, and said LCD displays said M-bit gradation signals without using Frame Rate Control (FRC).

2. The liquid crystal display (LCD) device as set forth in claim 1, wherein a gamma (γ) for each of said sub-pixels is greater than a gamma (γ) for said pixel.

3. The liquid crystal display (LCD) device as set forth in claim 1, wherein a drive voltage associated with input data is concurrently applied to said sub-pixels.

4. The liquid crystal display (LCD) device as set forth in claim 1, wherein a sum of a maximum brightness in each of said sub-pixels is equal to a brightness associated with a maximum gradation of said pixel.

5. A liquid crystal display (LCD) device comprising:

a decoder receiving an N-bit input gradation signal, said decoder converting said N-bit input gradation signal into a plurality of M-bit gradation signals; and a LCD having a plurality of pixels, said pixels having a plurality of sub-pixels, said LCD receiving said M-bit gradation signals, wherein a gradation and a brightness in each of said sub-pixels have a non-linear relation to each other, and a desired brightness for said pixel is selected by selecting a gradation in each of said sub-pixels, wherein N is greater than M, where N and M are positive integers, said device further comprising a computing unit which computes said relation in each of said sub-pixels, and transmits the thus computed relation to a source driver, and a computing device which computes a gradation associated with each of said sub-pixels in dependence on a gradation of input data, wherein said LCD displays said M-bit gradation signals without using Frame Rate Control (FRC).

6. The liquid crystal display (LCD) device as set forth in claim 5, wherein a gamma (γ) for each of said sub-pixels is greater than a gamma (γ) for said pixel.

7. The liquid crystal display (LCD) device as set forth in claim 5, wherein a drive voltage associated with input aata is concurrently applied to said sub-pixels.

8. The liquid crystal display (LCD) device as set forth in claim 5, wherein a sum of a maximum brightness in each of said sub-pixels is equal to a brightness associated with a maximum gradation of said pixel.

9. The liquid crystal display (LCD) device as set forth in claim 5, wherein said computing unit computes said relation in each of said sub-pixels through the use of a specific algorithm.

* * * * *

UNITED STATES PATENT AND TRADEMARK OFFICE

CERTIFICATE OF CORRECTION

PATENT NO. : 7,202,845 B2
APPLICATION NO. : 10/212451
DATED : April 10, 2007
INVENTOR(S) : Koga et al.

It is certified that error appears in the above-identified patent and that said Letters Patent is hereby corrected as shown below:

Claim 7, Col. 12, line 2, “input aata is” should be --input data is--.

Signed and Sealed this

Tenth Day of February, 2009

John Doll

JOHN DOLL
*Acting Director of the United States Patent and Trademark Office*